US010975680B2

(12) United States Patent
Jeffryes et al.

(10) Patent No.: US 10,975,680 B2
(45) Date of Patent: Apr. 13, 2021

(54) SYSTEM AND METHOD FOR MITIGATING A MUD MOTOR STALL

(71) Applicant: Schlumberger Technology Corporation, Sugar Land, TX (US)

(72) Inventors: Benjamin Peter Jeffryes, Histon (GB); Samba Ba, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/569,047

(22) PCT Filed: Apr. 28, 2016

(86) PCT No.: PCT/US2016/029750
§ 371 (c)(1),
(2) Date: Oct. 24, 2017

(87) PCT Pub. No.: WO2016/176428
PCT Pub. Date: Nov. 3, 2016

(65) Prior Publication Data

US 2018/0135402 A1 May 17, 2018

Related U.S. Application Data

(60) Provisional application No. 62/153,967, filed on Apr. 28, 2015.

(51) Int. Cl.
*E21B 4/02* (2006.01)
*E21B 44/06* (2006.01)

(52) U.S. Cl.
CPC ..... *E21B 44/06* (2013.01); *E21B 4/02* (2013.01)

(58) Field of Classification Search
CPC ..... E21B 44/06; E21B 4/02
See application file for complete search history.

(56) References Cited

U.S. PATENT DOCUMENTS

| | | | | |
|---|---|---|---|---|
| 6,019,180 | A | 2/2000 | Pafitis et al. | |
| 2005/0199053 | A1 | 9/2005 | Butler et al. | |
| 2009/0205869 | A1* | 8/2009 | Prill | E21B 4/02 175/40 |
| 2012/0145455 | A1 | 6/2012 | Mock et al. | |
| 2013/0277112 | A1 | 10/2013 | Edbury et al. | |
| 2016/0273346 | A1* | 9/2016 | Tang | E21B 43/04 |

FOREIGN PATENT DOCUMENTS

WO WO9816712 A1 4/1998

OTHER PUBLICATIONS

International Search Report and Written Opinion issued in International Patent application PCT/US2016/029750, dated Aug. 9, 2016. 15 pages.

* cited by examiner

*Primary Examiner* — Nicole Coy
*Assistant Examiner* — Yanick A Akaragwe

(57) ABSTRACT

A system and method for operating a mud motor in a wellbore. The method includes running the mud motor into the wellbore. A threshold rate of a pressure increase over time is selected. A rate of a pressure increase over time is measured across the mud motor in the wellbore. A flow rate of a fluid being pumped into the wellbore is varied when the measured rate is greater than or equal to the threshold rate.

16 Claims, 7 Drawing Sheets

SYSTEM AND METHOD FOR MITIGATING A MUD MOTOR STALL

CROSS REFERENCE TO RELATED APPLICATIONS

This application claims priority under 35 U.S.C. § 119(e) from Provisional Patent Application No. 62/153,967 filed Apr. 28, 2015, which is hereby incorporated by reference in its entirety.

BACKGROUND

A mud motor is a downhole tool that uses hydraulic power from fluid flowing therethrough to drive a drill bit. Each mud motor has a specification sheet that provides a user with information about the operation of the mud motor. The specification sheet may identify a differential pressure versus rotations per minute ("RPM") curve for the mud motor at a given flow rate through the mud motor. As the differential pressure increases, the RPM generally decrease toward zero, at which point the mud motor stalls. For example, the specification sheet may indicate that the mud motor stalls (i.e., the RPM=0) at 4100 PSI when the flow rate through the mud motor is 600 GPM. In the field, however, this same mud motor may actually stall at lower pressures (e.g., 2500 PSI) when the flow rate is 600 GPM, which makes it difficult for the user to predict when the mud motor will stall and prevent this from occurring.

After a stall, the mud motor may quickly accelerate again. For example, the mud motor may accelerate from 0 RPM to 200 RPM in less than 0.5 seconds, which results in a large inertial rotational acceleration. As can be appreciated, accelerating at this rate may damage the mud motor and reduce the life expectancy thereof.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A method for operating a mud motor in a wellbore is disclosed. The method includes running the mud motor into the wellbore. A threshold rate of a pressure increase over time is selected. A rate of a pressure increase over time across is measured the mud motor in the wellbore. A flow rate of a fluid being pumped into the wellbore is varied when the measured rate is greater than or equal to the threshold rate.

A non-transitory computer-readable medium is also disclosed. The medium stores instructions that, when executed by at least one processor of a computing system, cause the computing system to perform operations. The operations include selecting a threshold rate of a pressure increase over time, measuring a rate of a pressure increase over time across a mud motor in a wellbore, and reducing a flow rate of a fluid being pumped into the wellbore when the measured rate is greater than or equal to the threshold rate.

A computing system is also disclosed. The computing system includes a processor and a memory system. The memory system includes a non-transitory computer-readable medium storing instructions that, when executed by the processor, cause the computing system to perform operations. The operations include selecting a threshold rate of a pressure increase over time, measuring a rate of a pressure increase over time across a mud motor in a wellbore, and varying a flow rate of a fluid being pumped into the wellbore when the measured rate is greater than or equal to the threshold rate.

BRIEF DESCRIPTION OF THE DRAWINGS

So that the recited features may be understood in detail, a more particular description, briefly summarized above, may be had by reference to one or more implementations, some of which are illustrated in the appended drawings. It is to be noted, however, that the appended drawings are illustrative implementations, and are, therefore, not to be considered limiting of its scope.

DETAILED DESCRIPTION

Figure 1:
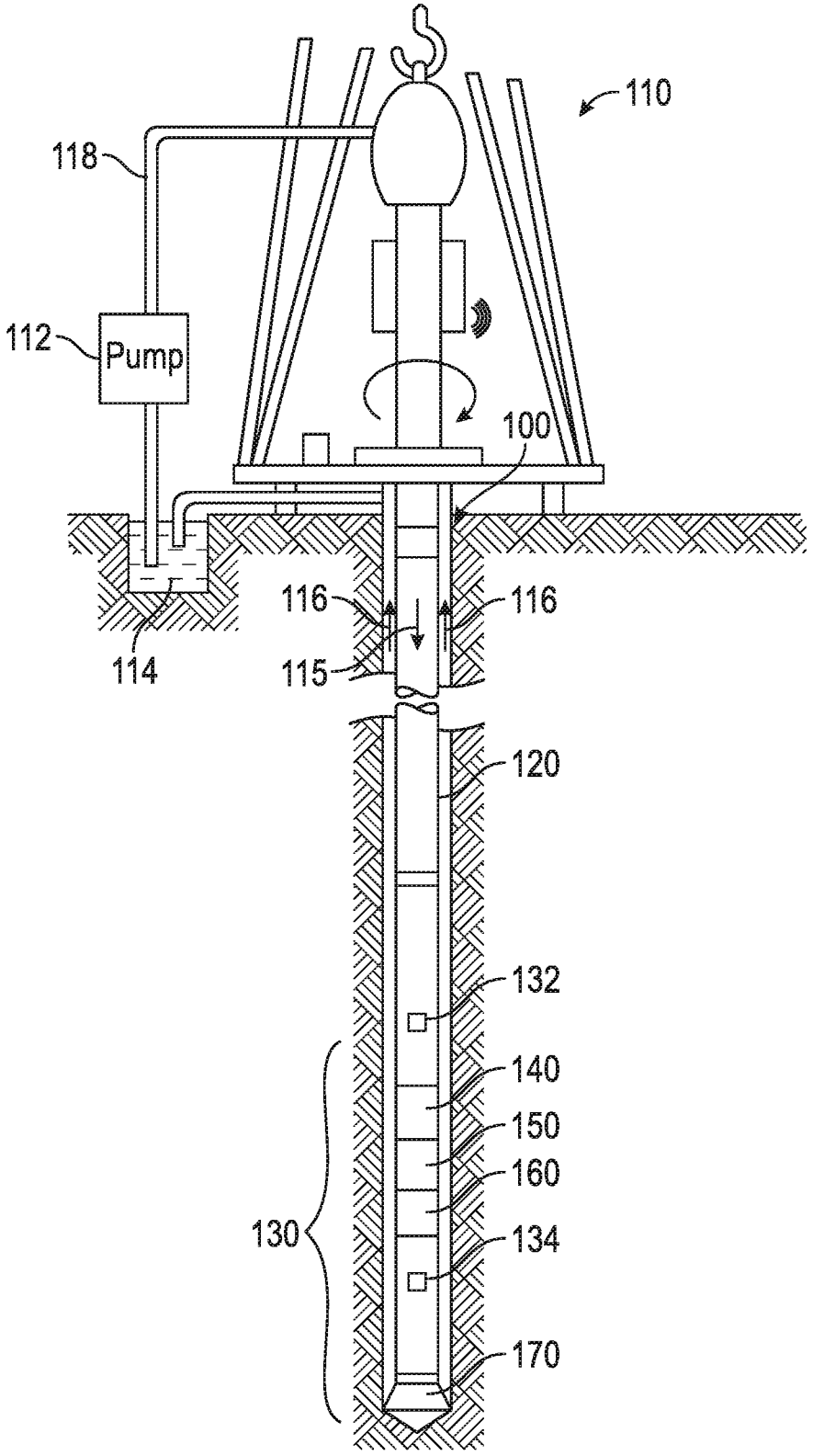
FIG. 1 depicts a cross-sectional view of a downhole tool in a wellbore, according to one or more implementations.

FIG. 1 depicts a cross-sectional view of a downhole tool 130 in a wellbore 100, according to one or more implementations. The downhole tool 130 may run into the wellbore 100 on a drill string 120 that extends downward from a derrick assembly 110. The downhole tool 130 may be or include a bottom hole assembly ("BHA") that includes a logging-while-drilling ("LWD") module 140, a measuring-while-drilling ("MWD") module 150, a mud motor 160, and drill bit 170.

The LWD module 140 may be configured to measure one or more formation properties as the wellbore 100 is being drilled or at any time thereafter. The formation properties may include resistivity, porosity, sonic velocity, gamma ray, and the like. The MWD module 150 may be configured to measure one or more physical properties as the wellbore 100 is being drilled or at any time thereafter. The physical properties may include pressure, temperature, wellbore trajectory, a weight-on-bit, torque-on-bit, vibration, shock, stick slip, and the like.

A pump 112 at the surface may cause a drilling fluid 114 to flow through the interior of the drill string 120, as indicated by the directional arrow 115. The drilling fluid 114 may flow through the mud motor 160, which may cause the mud motor 160 to mechanically drive the drill bit 170. After passing through the mud motor 160, the drilling fluid 114 may flow out of the drill bit 170 and then circulate upwardly through the annulus between the outer surface of the drill string 120 and the wall of the wellbore 100, as indicated by the directional arrow 116.

As the mud motor 160 drives the drill bit 170, the pressure measured at the surface (e.g., at standpipe 118) may be the sum of the pressure drops in the system plus any hydrostatic pressures. For example, this may include the annular frictional pressure drop, the pressure due to the weight of the cuttings in the annulus, the pressure drop along the drill string 120, the pressure drop across the mud motor 160, and the pressure drop across the drill bit 170.

As the drill bit 170 drills through different layers in the subterranean formation, the downhole tool 130 may experience transient events which may include rapid variations in pressure. In some implementations, these variations in pressure may be measured at the surface (e.g., at the standpipe 118). However, the pressure variation measured at the surface (e.g., at the standpipe 118) may not be the same as the pressure variation downhole. More particularly, the amplitude of the pressure variation measured at the surface may be less than the actual amplitude of the pressure variation across the mud motor 160.

At higher frequencies, this may be at least partially due to acoustic attenuation. At lower frequencies, this may be due to the combination of: fluid compliance effects of the fluid in the drill string 120 above the mud motor 160, the pressure drop across the drill bit 170, or a combination thereof. For example, at low frequencies, if there is a fluctuation in pressure in the drill string 120:

$$Q_b = Q_p - \Lambda \frac{dP_d}{dt} \tag{1}$$

where $Q_b$ represents the flow rate at the drill bit 170. $Q_p$ represents the flow rate from the pump 112, $\Lambda$ represents the compliance of the fluid above the mud motor 160, and $P_d$ represents the pressure inside the drill string 120. As used herein, "compliance" refers to the volume of the fluid, divided by its bulk modulus.

The pressure drop across the components of the downhole tool 130 below the mud motor 160 (e.g., including the drill bit 170) may be approximated as being proportional to the flow rate squared. For example:

$$P_b = \frac{k}{2}\left(Q_p - \Lambda \frac{dP_d}{dt}\right)^2 \tag{2}$$

where $P_b$ represents the pressure drop across the drill bit 170, and ½ k represents the constant of proportionality.

Since the changes in the flow rate induced by the pressure changes may be smaller than the flow rate from the pump 112, a linear approximation in the rate of change in the pump pressure may be made:

$$P_b = \frac{k}{2}Q_p^2 - kQ_p\Lambda \frac{dP_d}{dt} \tag{3}$$

If there is a pressure variation near the bottom of the wellbore 100, then the pump pressure may be the sum of the pressure variation near the bottom of the wellbore 100 plus the pressure drop across the drill bit 170. The pressure drop across the mud motor 160, $P_m$, and the hydrostatic column pressure, $P_k$, are also included. Thus:

$$P_b = \left[P_k + \frac{k}{2}Q_p^2\right] + P_m - kQ_p\Lambda \frac{dP_d}{dt} \tag{4}$$

The combination $kQ_p\Lambda$ has dimensions in the time domain. Accordingly:

$$T = kQ_p\Lambda \tag{5}$$

Then, $$P_d + T\frac{dP_d}{dt} = P_m + \left[P_k + \frac{k}{2}Q_p^2\right] \tag{6}$$

The solution to equation (6) may be:

$$P_d = \frac{1}{T}\int_0^\infty \exp\left(-\frac{\tau}{T}\right)P_m(t-\tau)d\tau + \left[P_k + \frac{k}{2}Q_p^2\right] \tag{7}$$

Thus, the pressure variation seen above the mud motor 160 (e.g., at the standpipe 118) due to the pressure variation across the mud motor 160 may be viewed as a low-pass filtered version of the actual pressure variation across the mud motor 160. There may also be additional attenuation mechanisms between the mud motor 160 and the surface that may cause the pressure variation seen at surface (e.g., at the standpipe 118) to be reduced even further.

In addition to causing the amplitude of the pressure variation sensed above the mud motor 160 (e.g., at the standpipe 118) to appear less than the actual pressure variation across the mud motor 160, the low-pass filter effect may also introduce a delay between the time that the pressure variation actually occurs and the time that the pressure variation is sensed (e.g., at the standpipe 118). This, in turn, may cause a delay between the torque seen at surface and the corresponding pressure variation seen at surface, which may be compensated for when comparing the variations in torque and pressure seen at the surface with the values measured downhole.

One method to estimate the pressure variation across the mud motor 160 using the data measured at the surface (e.g., at the standpipe 118) may be to invert for the effects of the low-pass filter. This may remedy the attenuation and the time-shift. Due to the noise in the surface data (e.g., caused by the mud pumps 112) and the low frequency nature of the theoretical derivation, the bandwidth over which the inversion is performed may be restricted, for instance, to frequencies lower than the inverse of the travel time for acoustic waves from the mud motor 160 to the surface and back. The time parameter for this inversion may either be derived theoretically or by estimating the delay between the surface torque and pressure signals (e.g., by the position of the cross-correlation peak between the two signals).

When the pressure variation causes the mud motor 160 to stall, the pressure above the mud motor 160 increases, causing a short-term decrease in the flow rate of fluid through the mud motor 160 because the fluid is compressed by the increased pressure. The low frequency, low-pass filter effects described above may begin at a time comparable to the time it takes for a signal in the fluid to travel to the surface and back. At shorter times, the decreased flow rate may be approximated by assuming that there is a pipe of infinite length above the downhole tool 130 with a cross-sectional area of the drill string 120. The impedance that links the pressure change to the change in flow rate may be represented by:

$$Z = \frac{\rho c}{A} = \frac{\kappa}{cA} = \frac{\sqrt{\rho\kappa}}{c} \tag{8}$$

where Z represents the impedance, p represents the fluid density, c represents the speed of sound (e.g., in drilling mud), A represents the cross-sectional area of the fluid in the pipe, and K represents the bulk modulus. The rate of change of the flow rate of the fluid may be the change in pressure divided by the impedance Z.

Figure 2:
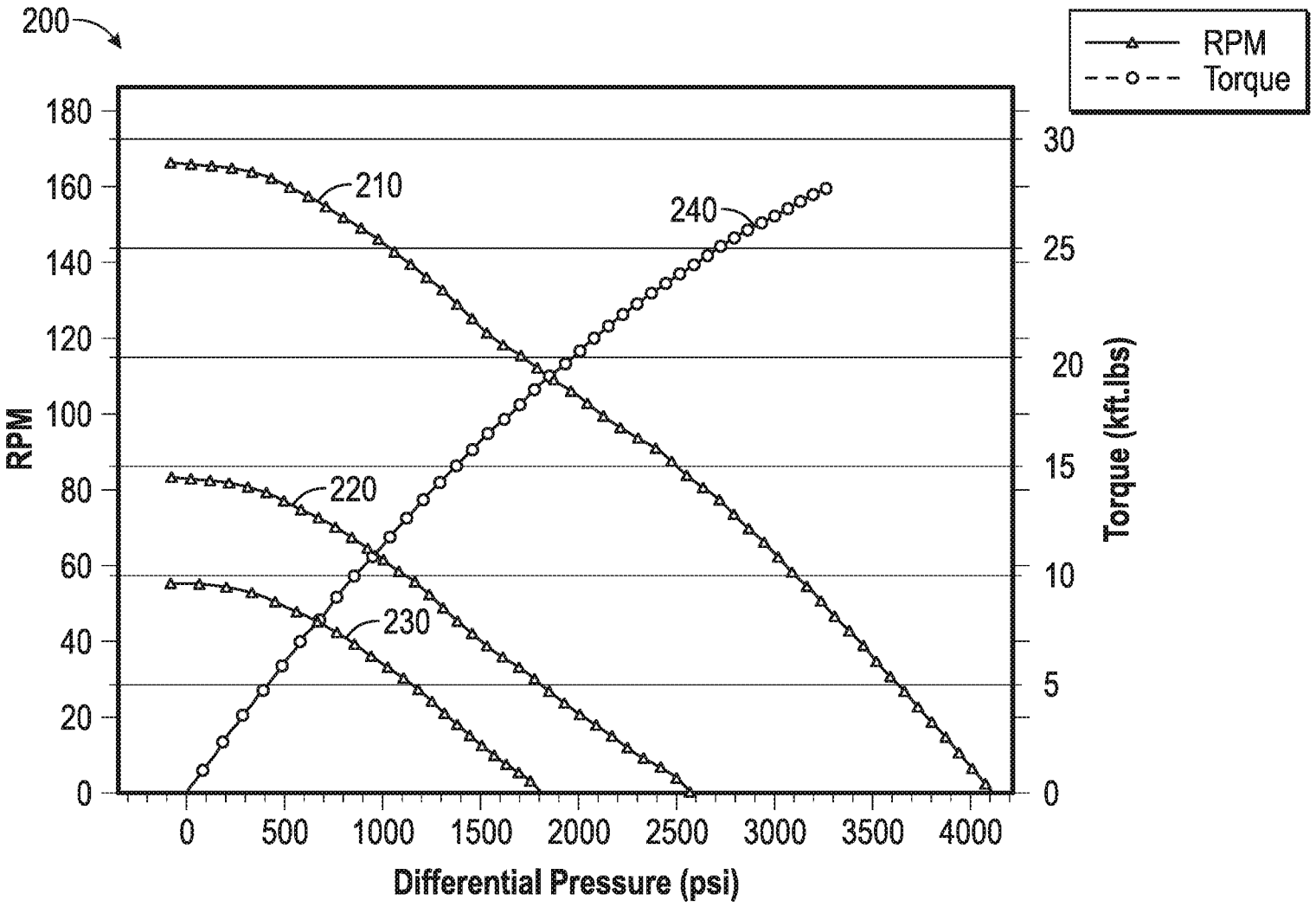
FIG. 2 depicts an illustrative graph from a specification sheet for a mud motor, according to one or more implementations.

FIG. 2 depicts an illustrative graph 200 from a specification sheet for the mud motor 160, according to one implementation. The graph 200 is a simulated power curve that shows the RPM and torque for varying differential pressures across the motor 160. For example, the graph 200 shows three curves 210, 220, 230 of differential pressure (X-axis) versus RPM (Y-axis). The first curve 210 represents a flow rate of 600 GPM being introduced into the wellbore 100 at the surface. The second curve 220 represents a flow rate of 300 GPM being introduced into the wellbore 100 at the surface. The third curve 230 represents a flow rate of 200 GPM being introduced into the wellbore 100 at the surface. The graph 200 also shows a curve 240 of differential pressure (X-axis) versus torque (Y-axis). Looking at the first curve 210 (i.e., flow rate=600 GPM), when drilling with a differential pressure of 1000 PSI, the mud motor 160 rotates at 140 RPM, and the torque provided by the mud motor 160 is 10 kftlbs (i.e., about 13,560 Nm).

Referring now to FIGS. 1 and 2, if, e.g., the drill bit 170 encounters a change in the formation, and the downhole tool 130 experiences a sudden pressure variation, the differential pressure across the mud motor 160 may increase. This pressure increase may occur suddenly, and the time delay may prevent the pressure increase from being measured at the surface (e.g., at the standpipe 118). Due to pressure increase, the flow rate of the fluid above the mud motor 160 may decrease by:

$$\Delta Q = -\frac{\Delta P}{Z} \tag{9}$$

where ΔQ represents the change in the flow rate, ΔP represents the change in pressure measured above the mud motor 160, and Z represents the impedance. The decrease in the flow rate of the fluid through the mud motor 160 may cause the RPM of the mud motor 160 to decrease, even though the surface measurements may indicate that the flow rate from the pump 112 remains constant. As a result, the mud motor 160 may stall (e.g., RPM=0) at a lower differential pressure than is indicated by the graph 200 on the specification sheet.

Figure 3:
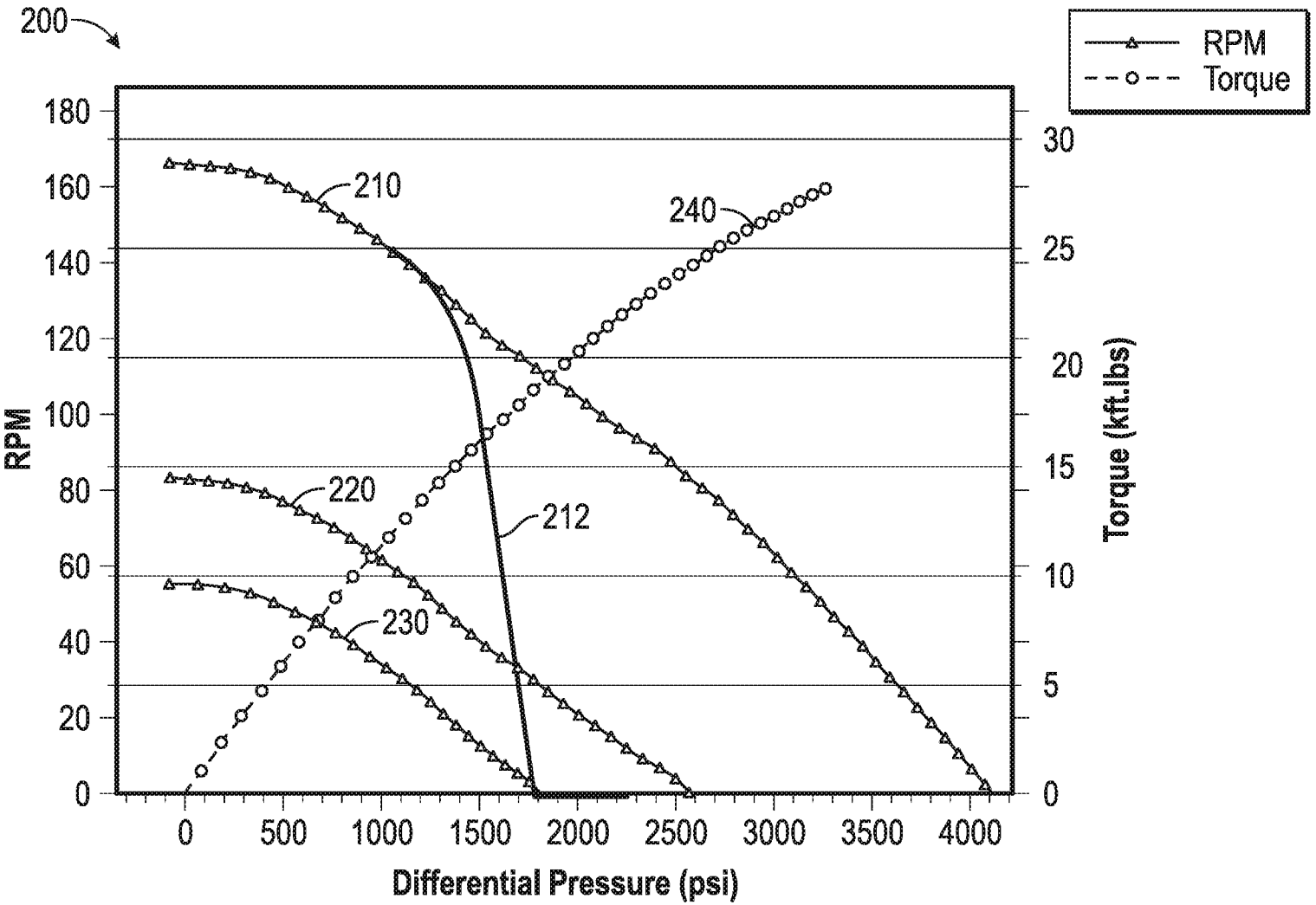
FIG. 3 depicts the graph from FIG. 2 showing a modified differential pressure versus RPM curve, according to one or more implementations.

The change in pressure above the drill bit 170 may be lower than the change in the pressure drop across the mud motor 160, as the resulting drop in flow rate may also reduce the pressure drop across the drill bit 170. An approximation for the ratio between the pressure change above the mud motor 160 (ΔP) and the pressure change across the mud motor 160 (δP) is:

$$\frac{\Delta P}{\delta P} = 1 - 4P_B\left(\frac{\left((ZQ + 2P_B - \delta P) + \sqrt{(ZQ + 2P_B)^2 - 4P_B\delta P}\right)}{\left((ZQ + 2P_B) + \sqrt{(ZQ + 2P_B)^2 - 4P_B\delta P}\right)^2}\right) \tag{10}$$

where Q is the surface flow rate and $P_B$ is the bit pressure drop at the surface flow rate FIG. 3 depicts the graph 200 from FIG. 2 showing a modified RPM versus differential pressure curve 212, according to one implementation. Continuing with the example above, and referring now to FIGS. 1 and 3, the downhole tool 130 may be drilling as drilling fluid at 600 GPM is pumped into the drill string 120 from the surface. The differential pressure may be 1000 PSI. The drill bit 170 may encounter a change in the formation, which causes the differential pressure to increase by 1200 PSI. When the drill string 120 has a three-inch inner diameter, Z=3 (equation 8) and ΔQ=−400 GPM (equation 9). In other words, the flow rate through the mud motor 160 decreases from 600 GPM to 200 GPM (i.e., curve 210 to curve 230). As a result, the pressure curve 210 for 600 GPM may actually behave more like the modified curve 212 shown in FIG. 3. Thus, the mud motor 160 may stall (e.g., RPM=0) at 1800 PSI instead of at 4100 PSI as originally anticipated. With this knowledge in mind, the size and type of mud motor 160 may be selected so that the mud motor 160 is sufficiently robust for drilling conditions that may be encountered.

Figure 4:
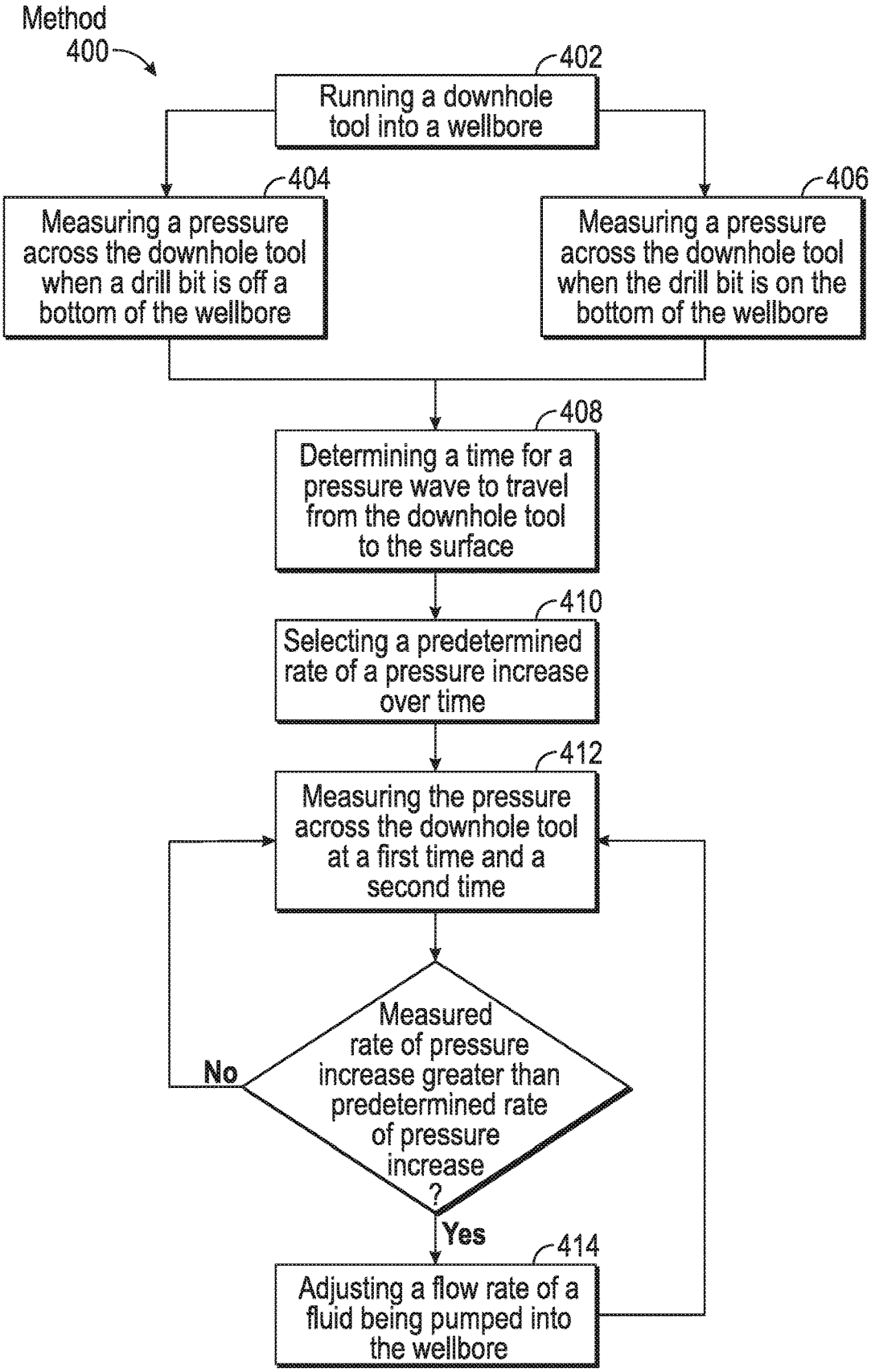
FIG. 4 depicts a flowchart of a method for preventing a mud motor from stalling, according to one or more implementations.

FIG. 4 depicts a flowchart of a method 400 for preventing a mud motor from stalling, according to one implementation. Referring now to FIGS. 1 and 4, the method 400 may begin by running the downhole tool 130 into the wellbore 100 (e.g., on the drill string 120), as at 402. The method 400 may then include measuring the differential pressure across the downhole tool 130 when the drill bit 170 is off the bottom of the wellbore 100, as at 404. The differential pressure across the downhole tool 130 may also be measured when the drill bit 170 is on the bottom of the wellbore 100 (e.g., while drilling), as at 406. The differential pressures at 404 and 406 may be or include the pressure across the mud motor 160. The differential pressures across the downhole tool 130 may be measured using one or more pressure sensors 132, 134 coupled to the downhole tool 130 (see FIG. 1). For example, one pressure sensor 132 may be positioned above the mud motor 160, and another pressure sensor 134 may be positioned below the mud motor 160. In another implementation, the differential pressures across the downhole tool 130 may be measured at the standpipe 118.

The time for a pressure wave $T_t$ encountered proximate to the downhole tool 130 to travel through the bore of the drill string 120 to the surface and back may be determined or estimated, as at 408. Factors to be considered when determining the time may include the type of fluid (e.g., mud) in the wellbore 100, the speed of sound in the fluid, the density of the fluid, the cross-sectional area of the inside of the drill string 120, the length of the drill string 120, or a combination thereof.

A predetermined or threshold rate of a pressure (e.g., increase) over time may be selected, as at 410. The threshold rate of the pressure increase over time may be based, at least partially, upon the differential pressures measured at 404 and 406, the time determined at 408, or a combination thereof. For example, under normal conditions, the difference between the differential pressures at 404 and 406 may provide an expected differential pressure across the mud motor 160. The threshold rate of the pressure increase over time may be selected to be greater than (e.g., 1.5 times or 2 times) or equal to the difference between the differential pressures 404 and 406. The pressure differential increase at 410 may be from about 500 PSI to about 1200 PSI or about 600 PSI to about 1000 PSI. The time at 410 may be less than or equal to the time $T_t$ at 408. For example, the time here may be from about 10 milliseconds (ms) to about 2 s or about 100 ms to about 1 s. Thus, in one example, the threshold rate may be about 600 PSI/s.

The differential pressure across the downhole tool 130 (e.g., across the mud motor 160) may then be measured at a first time and at a second time, as at 412. The differential pressure across the downhole tool 130 may be measured at the first and second times using the pressure sensor(s) 132, 134 coupled to the downhole tool 130 (see FIG. 1). The pressure sensors 132 and 134 may provide a more accurate reading than the sensor at standpipe 118; however, if measurements from one or both pressure sensors 132, 134 are not available, the pressure measured at the standpipe 118 may be used. The difference between the first time and the second time may be less than or equal to the time $T_t$ at 408. For example, the difference between the first time and the second time may be from about 10 ms to about 1 s or about 50 ms to about 500 ms.

In another implementation, the differential pressure across the mud motor 160 may be estimated using the pressure measured at the sensor 132, subtracting from it the pressure measured at the sensor 132 when the mud motor 160 is rotating with the drill bit 170 off-bottom, and adjusting for the known pressure to rotate the mud motor 160 with no load. Based on this measured pressure above the mud motor 160, equation 10 may be used to estimate the pressure drop across the mud motor 160. For example, equation 10 may be applied for spikes of duration shorter than the two-way travel time to the surface, $T_t$. Should the pressure measurement 132 not be available, similar processing may be applied to the pressure measured at standpipe 118.

From the measurement at 412, a measured rate of a pressure (e.g., increase) over time may be determined. If the measured rate is greater than or equal to the selected threshold rate (e.g., over a time scale that is less than or equal to the time $T_t$), it may be assumed that the mud motor 160 has stalled. In response to this, equation 1 may be used to adjust the flow rate of the fluid being pumped into the wellbore 100 (e.g., with pump 112), as at 414. For example, the flow rate may be decreased. This may reduce the damage to the mud motor 160 caused by the stall. In other implementations, the flow rate may be increased.

Figure 5A:
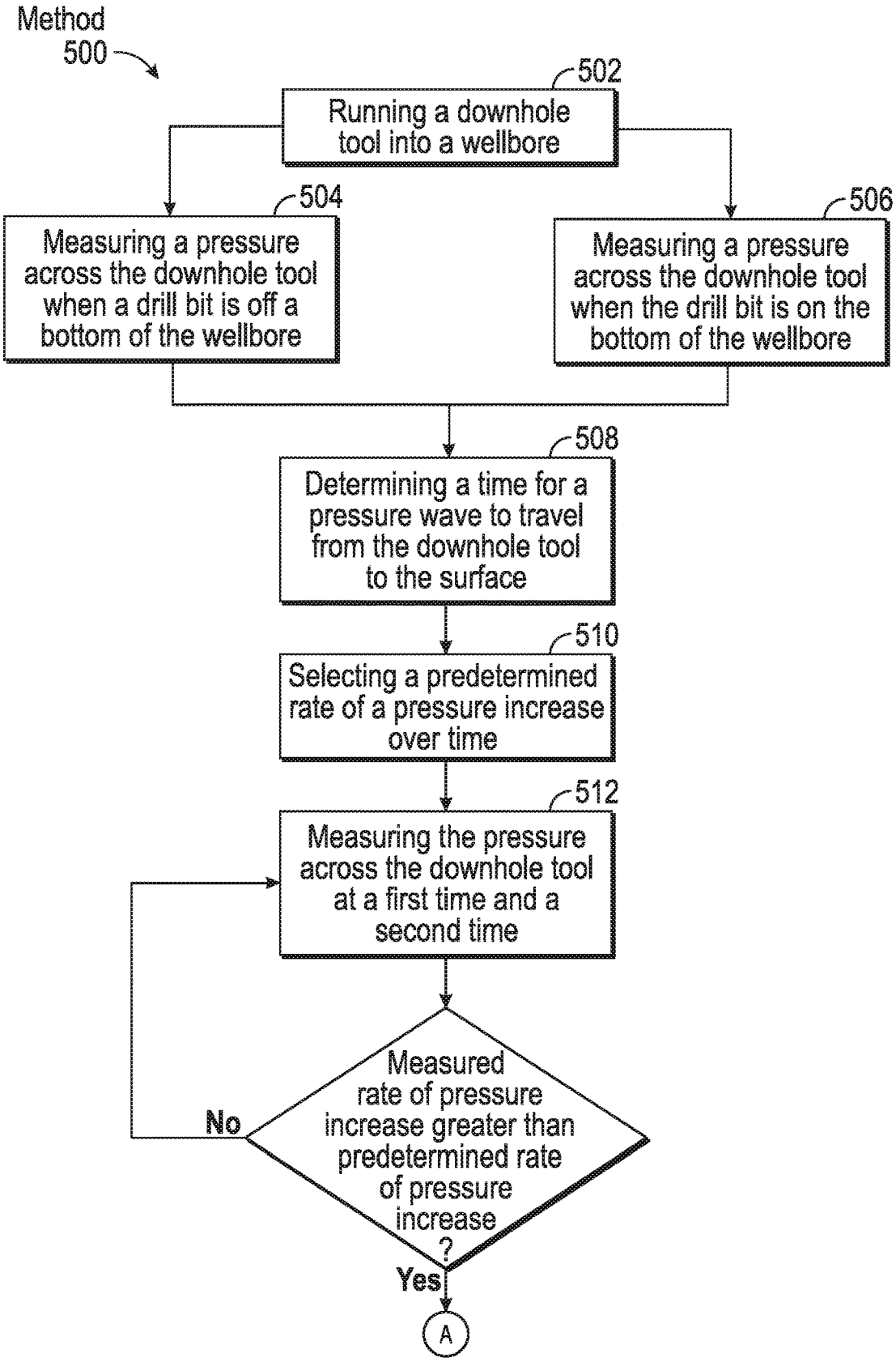
FIGS. 5A and 5B depict a flowchart of a method for operating the downhole tool after the mud motor stalls, according to one or more implementations.
Figure 5B:
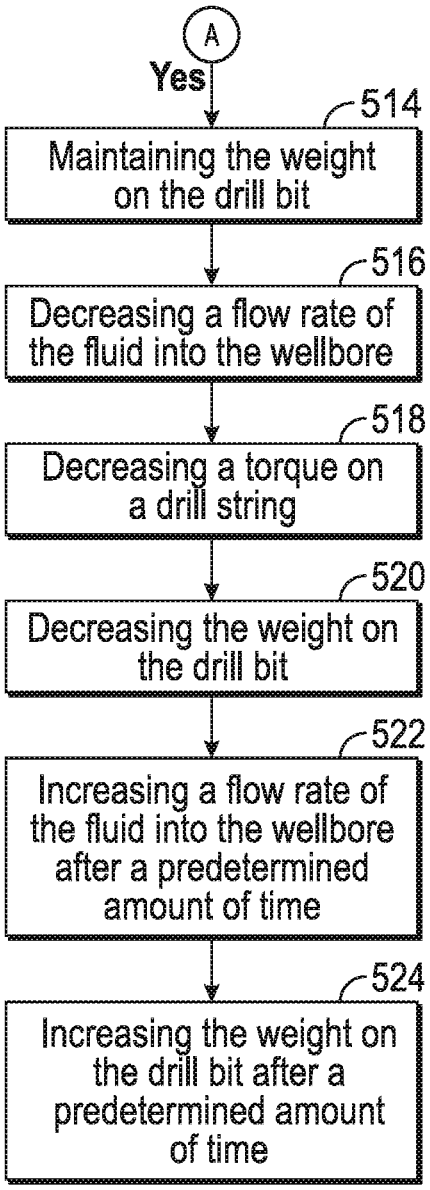

FIGS. 5A and 5B depict a flowchart of a method 500 for operating the downhole tool 130 after the mud motor 160 stalls, according to one implementation. Referring now to FIGS. 1, 5A and 5B, the method 500 may begin in much the same way as the method 400. For example, boxes 502, 504, 506, and 508 may be the same as boxes 402, 404, 406, and 408 in FIG. 4.

A threshold rate of a pressure (e.g., increase) over time may be selected, as at 510. The rate selected at 510 may be the same as or greater than the rate selected at 410. The pressure increase may be from about 500 PSI to about 1200 PSI or about 600 PSI to about 1000 PSI. The time here may be less than or equal to the travel time at 508. For example, the time may be from about 10 ms to about 1 s. In one example, the threshold rate may be about 600 PSI/1000 ms.

The differential pressure across the downhole tool 130 (e.g., across the mud motor 160) may then be measured at a first time and at a second time, as at 512. The differential pressure across the downhole tool 130 may be measured at the first and second times using the pressure sensor(s) 132, 134 coupled to the downhole tool 130 (see FIG. 1). The difference between the first time and the second time may be less than or equal to the travel time at 508. For example, the difference between the first time and the second time may be from about 10 ms to about 1 s.

From the measurement at 512, a measured rate of a pressure (increase) over time may be determined. If the measured rate is greater than or equal to the threshold rate, then it may be assumed or determined that the mud motor 160 has stalled. When this occurs, the weight on the drill bit 170 may be maintained (e.g., remain substantially constant), as at 514. The flow rate of the fluid into the wellbore 100 (e.g., from the pump 112) may be decreased, as at 516. This may occur while the weight on the drill bit 170 is maintained. The torque in the drill string 120 may also be decreased, as at 518. This may also occur while the weight on the drill bit 170 is maintained. The torque may be reduced my applying a brake on the drill string 120 to slow the rate of rotation of the drill string 120, which may be different from the rate of rotation of the mud motor 160.

Once the flow rate has been decreased, the torque has been decreased, or both, then the weight on the drill bit 170 may be decreased, as at 520. For example, the drill bit 170 may be picked up off of the bottom of the wellbore 100. After a first predetermined amount of time off of the bottom, the flow rate of the fluid into the wellbore 100 (e.g., from the pump 112) may be increased, as at 522. The first predetermined time may be from about $2*T_t$ to about $5*T_t$, about $5*T_t$ to about $10*T_t$, about $10*T_t$ to about $100*T_t$, or more, where $T_t$ represents the travel time of the pressure wave up to the surface. After a second predetermined amount of time off of the bottom, the drill bit 170 may be lowered until it contacts the bottom again, as at 524. The second predetermined time may be from about $2*T_t$ to about $5*T_t$, about $5*T_t$ to about $10*T_t$, about $10*T_t$ to about $130*T_t$, or more. For example, the first and second predetermined times may be substantially the same.

Figure 6:
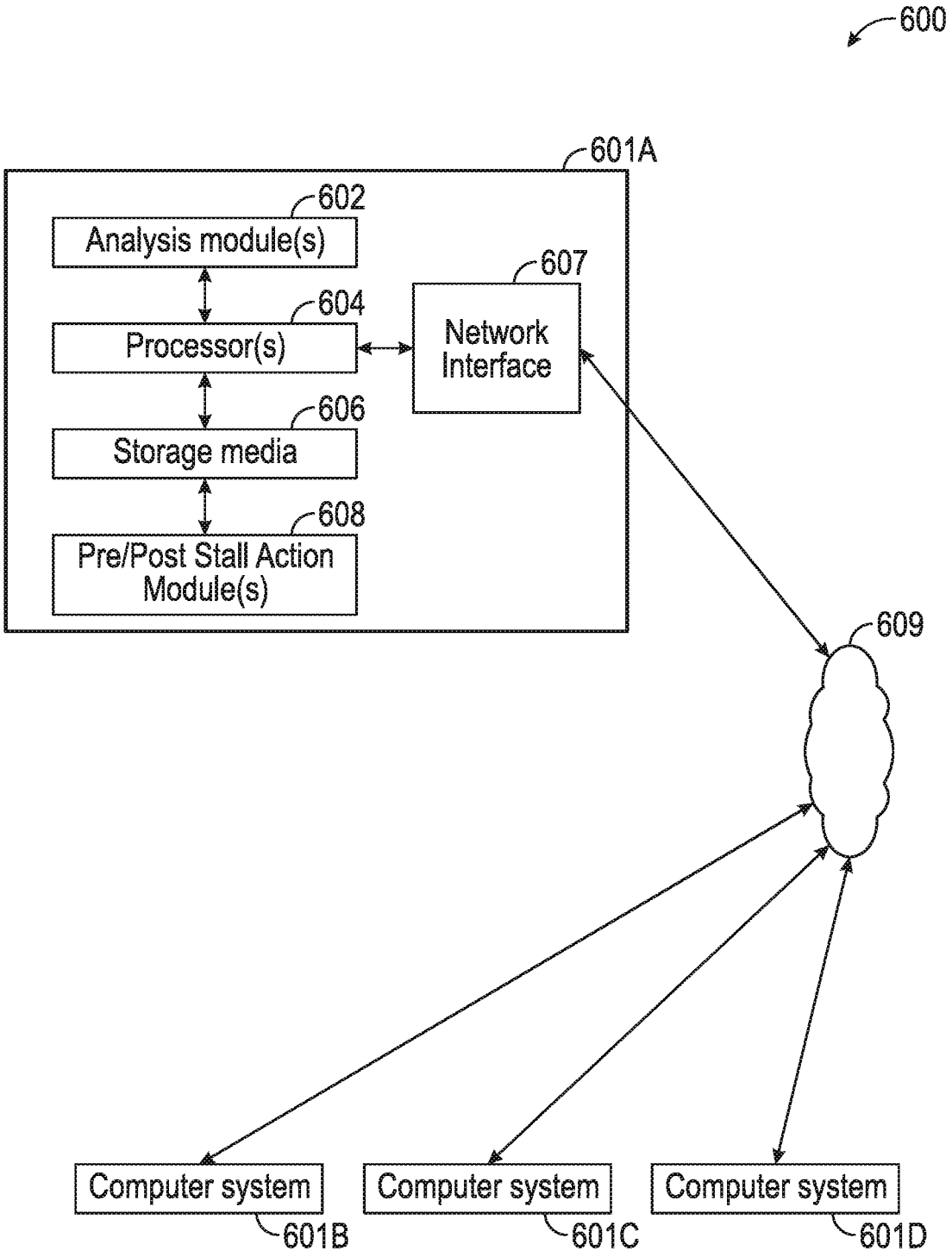
FIG. 6 depicts a computing system for performing one or more of the methods disclosed herein, according to one or more implementations.

In some implementations, any of the methods 400 or 500 may be executed by a computing system. FIG. 6 illustrates an example of such a computing system 600. At least a portion of the computing system 600 may be located in the downhole tool 130 or at a surface location. The computing system 600 may include a computer or computer system 601A, which may be an individual computer system 601A or an arrangement of distributed computer systems. The computer system 601A includes one or more analysis module(s) 602 configured to perform various tasks according to some implementations, such as one or more methods disclosed herein (e.g., methods 400, 500, and/or combinations and/or variations thereof). To perform these various tasks, the analysis module 602 executes independently, or in coordination with, one or more processors 604, which is (or are) connected to one or more storage media 606. The processor(s) 604 is (or are) also connected to a network interface 607 to allow the computer system 601A to communicate over a data network 609 with one or more additional computer systems and/or computing systems, such as 601B, 601C, and/or 601D (note that computer systems 601B, 601C and/or 601D may or may not share the same architecture as computer system 601A, and may be located in different physical locations, e.g., computer systems 601A and 601B may be located in a processing facility, while in communication with one or more computer systems such as 601C and/or 601D that are located in one or more data centers, and/or located in varying countries on different continents).

A processor can include a microprocessor, microcontroller, processor module or subsystem, programmable integrated circuit, programmable gate array, or another control or computing device.

The storage media 606 can be implemented as one or more computer-readable or machine-readable storage media. In the example implementation of FIG. 6 storage media 606 is depicted as within computer system 601A, however, in some implementations, storage media 606 may be distributed within and/or across multiple internal and/or external enclosures of computing system 601A and/or additional computing systems. Storage media 606 may include one or more different forms of memory, including but not limited to: semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLU-ERAY® disks, or other types of optical storage, or other types of storage devices. The instructions discussed above can be provided on one computer-readable or machine-readable storage medium, or alternatively, can be provided on multiple computer-readable or machine-readable storage media distributed in a large system having possibly plural nodes. Such computer-readable or machine-readable storage medium or media is (are) considered to be part of an article (or article of manufacture). An article or article of manufacture can refer to any manufactured single component or multiple components. The storage medium or media can be located either in the machine running the machine-readable instructions, or located at a remote site from which machine-readable instructions can be downloaded over a network for execution.

In some implementations, computing system 600 contains one or more pre/post stall action module(s) 608. In the example of computing system 600, computer system 601A includes the pre/post stall action module 608. In some implementations, a single pre/post stall action module may be used to perform some or all aspects of one or more implementations of the methods 400 or 500. In alternative implementations, a plurality of pre/post stall action modules may be used to perform some or all aspects of methods 400 or 500.

It should be appreciated that computing system 600 is one example of a computing system, and that computing system 600 may have more or fewer components than shown, may combine additional components not depicted in the example implementation of FIG. 6, and/or computing system 600 may have a different configuration or arrangement of the components depicted in FIG. 6. The various components shown in FIG. 6 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are included within the scope of protection of the disclosure.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

While the foregoing is directed to one or more implementations of the disclosure, those skilled in the art will readily appreciate that many modifications are possible in the example implementations without materially departing from the disclosure. Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention not to invoke means plus function treatment for any limitations of any of the claims herein, except for those in which the claim expressly uses the words 'means for' together with an associated function.

What is claimed is:

1. A method for operating a mud motor in a wellbore, comprising:

running the mud motor into the wellbore;

measuring a first pressure across the mud motor when a drill bit is on a bottom of the wellbore;

measuring a second pressure across the mud motor when the drill bit is off the bottom of the wellbore;

selecting a threshold rate of a pressure increase over a time scale, wherein the time scale is less than a wave time for a pressure wave to travel from proximate the mud motor to a surface location, wherein the threshold rate is selected based at least partially upon the first pressure, the second pressure, or a combination thereof, and the threshold rate is greater than or equal to the difference between the first and second pressures divided by the wave time for the pressure wave to travel from proximate the mud motor to the surface location;

measuring a rate of a pressure increase over the time scale across the mud motor in the wellbore;

determining the wave time based on a type of a fluid pumped into the wellbore, a speed of sound in the fluid, a density of the fluid, a cross-sectional area of the drill string between the mud motor and the surface location, a length of the drill string, or any combination thereof; and varying a flow rate of a fluid being pumped into the wellbore when the measured rate is greater than or equal to the threshold rate.

2. The method of claim 1, wherein the rate of the pressure increase over the time scale across the mud motor is measured with one or more pressure sensors coupled proximate to the mud motor.

3. The method of claim 1, wherein varying the flow rate of the fluid being pumped into the wellbore comprises increasing the flow rate of the fluid being pumped into the wellbore.

4. The method of claim 1, further comprising determining that the mud motor has stalled when the measured rate is greater than or equal to the threshold rate.

5. The method of claim 1, wherein varying the flow rate of the fluid being pumped into the wellbore comprises decreasing the flow rate of the fluid being pumped into the wellbore.

6. The method of claim 5, further comprising decreasing a rate of rotation of a drill string, wherein the mud motor is coupled to the drill string.

7. The method of claim 6, wherein weight on drill bit is kept substantially constant while the flow rate is decreased, while the rate of rotation of the drill string is decreased, or both.

8. The method of claim 6, further comprising:

decreasing weight on drill bit after the flow rate is decreased, after the rate of rotation of the drill string is decreased, or after both; and increasing the flow rate of the fluid being pumped into the wellbore a predetermined amount of time after weight on drill bit is decreased, wherein the predetermined amount of time is from about 2 times to about 100 times the wave time for the pressure wave to travel from proximate the mud motor to the surface location.

9. The method of claim 6, further comprising:

decreasing weight on drill bit after the flow rate is decreased, after the rate of rotation of the drill string is decreased, or after both; and increasing weight on drill bit a predetermined amount of time after weight on drill bit is decreased, wherein the predetermined amount of time is from about 2 times to about 100 times the wave time for the pressure wave to travel from proximate the mud motor to the surface location.

10. A non-transitory computer-readable medium storing instructions that, when executed by at least one processor of a computing system, cause the computing system to perform operations, the operations comprising:

measuring a first pressure drop across a mud motor in a wellbore at a first time when a drill bit is on a bottom of the wellbore and a second pressure drop across the mud motor in the wellbore at a second time when the drill bit is off the bottom of the wellbore, a pressure increase being a pressure difference between the first pressure drop and the second pressure drop, a time difference being a duration between the first time and the second time that is less than a wave time for a pressure wave to travel from proximate the mud motor to a surface location, and a measured rate of a pressure increase over time being the pressure difference divided by the time difference;

selecting a threshold rate of the pressure increase over time as the pressure difference between the first pressure drop and the second pressure drop divided by the wave time; and reducing a flow rate of a fluid being pumped into the wellbore when the measured rate is greater than or equal to the threshold rate.

11. A computing system comprising:

one or more processors; and a memory system having one or more non-transitory computer-readable media storing instructions that, when executed by at least one of the one or more processors, cause the computing system to perform operations, the operations including:

measuring a first pressure across a mud motor in a wellbore at a first time when a drill bit is on a bottom of the wellbore;

measuring a second pressure across the mud motor in the wellbore at a second time when the drill bit is off the bottom of the wellbore;

selecting a threshold rate of a pressure increase over a time scale, wherein the time scale is less than a wave time for a pressure wave to travel from proximate a mud motor to a surface location, wherein the threshold rate is greater than 250 psi/s, the threshold rate is selected based at least partially upon the first pressure, the second pressure, or a combination thereof, and the threshold rate is greater than or equal to the difference between the first and second pressures divided by the wave time for the pressure wave to travel from proximate the mud motor to the surface location;

measuring a plurality of pressure measurements across the mud motor in a wellbore over a plurality of time scales;

determining the wave time based on a type of a fluid pumped into the wellbore, a speed of sound in the fluid, a density of the fluid, a cross-sectional area of the drill string between the mud motor and the surface location, a length of the drill string, or any combination thereof;

deriving a rate of a pressure increase over each time scale of the plurality of time scales based on the plurality of pressure measurements; and varying a flow rate of a fluid being pumped into the wellbore when the derived rate is greater than or equal to the threshold rate.

12. The computing system of claim 11, wherein varying the flow rate of the fluid being pumped into the wellbore includes increasing the flow rate of the fluid being pumped into the wellbore.

13. The computing system of claim 11, wherein varying the flow rate of the fluid being pumped into the wellbore includes decreasing the flow rate of the fluid being pumped into the wellbore.

14. The computing system of claim 13, wherein the operations further include:

decreasing a rate of rotation of a drill string, wherein the mud motor is coupled to the drill string; and decreasing the weight on a drill bit after the flow rate is decreased, after the rate of rotation of the drill string is decreased, or after both.

15. The computing system of claim 14, further comprising increasing the flow rate of the fluid being pumped into the wellbore a predetermined amount of time after weight on drill bit is decreased, wherein the predetermined amount of time is from about 2 times to about 100 times the wave time for the pressure wave to travel from proximate the mud motor to the surface location.

16. The method of claim 1, wherein the time scale is less than 2 seconds, and the threshold rate of a pressure increase is greater than 250 psi/s.

* * * * *